US005985137A

United States Patent [19]

Ohsol et al.

[11] Patent Number: 5,985,137

[45] Date of Patent: Nov. 16, 1999

[54] PROCESS TO UPGRADE CRUDE OILS BY DESTRUCTION OF NAPHTHENIC ACIDS, REMOVAL OF SULFUR AND REMOVAL OF SALTS

[75] Inventors: Ernest O. Ohsol, Crosby; Thomas E. Gillespie; John W. Pinkerton, both of Houston, all of Tex.

[73] Assignee: Unipure Corporation, Houston, Tex.

[21] Appl. No.: 09/031,343

[22] Filed: Feb. 26, 1998

[51] Int. Cl.[6] ..... C10G 17/00; C10G 19/00

[52] U.S. Cl. ..... 208/263; 208/226; 208/229; 208/283; 208/284; 208/286

[58] Field of Search ..... 208/229, 226, 208/263, 283, 284, 286

[56] References Cited

U.S. PATENT DOCUMENTS

| | | | |
|---|---|---|---|
| 2,451,025 | 10/1948 | Ellender | 208/263 |
| 4,938,876 | 7/1990 | Ohsol | 210/708 |
| 5,871,637 | 2/1999 | Brons | 208/283 |

FOREIGN PATENT DOCUMENTS

| | | | |
|---|---|---|---|
| WO 97/08270 | 3/1997 | WIPO | C10G 19/00 |

*Primary Examiner*—Marian C. Knode
*Assistant Examiner*—In Suk Bullock
*Attorney, Agent, or Firm*—Jenkens & Gilchrist, PC

[57] ABSTRACT

A method for upgrading an oil stream containing naphthenic acid and sulfur contaminants is described. In this method, an oil stream with naphthenic acid and sulfur contaminants is upgraded by the following steps. First, the oil stream is mixed with an alkaline earth metal oxide in an amount effective to convert substantially all of the naphthenic acid contaminants to non-acidic compounds and alkaline earth metal carbonate and also to convert substantially all of the sulfur contaminants to alkaline earth metal sulfide. Then, the mixture is heated under a pressure sufficient to prevent vaporization of the mixture to a temperature sufficient and for a time sufficient to react the naphthenic acid contaminants with the alkaline earth oxide to form the corresponding non-acidic compounds and alkaline earth carbonates. In the meantime, substantially all of the sulfur contaminants react with the alkaline earth oxide to form the alkaline earth sulfide. After the desired reaction is complete, the alkaline earth carbonate and the alkaline earth sulfide is separated from the oil stream. Upgraded oil is thus obtained.

32 Claims, 1 Drawing Sheet

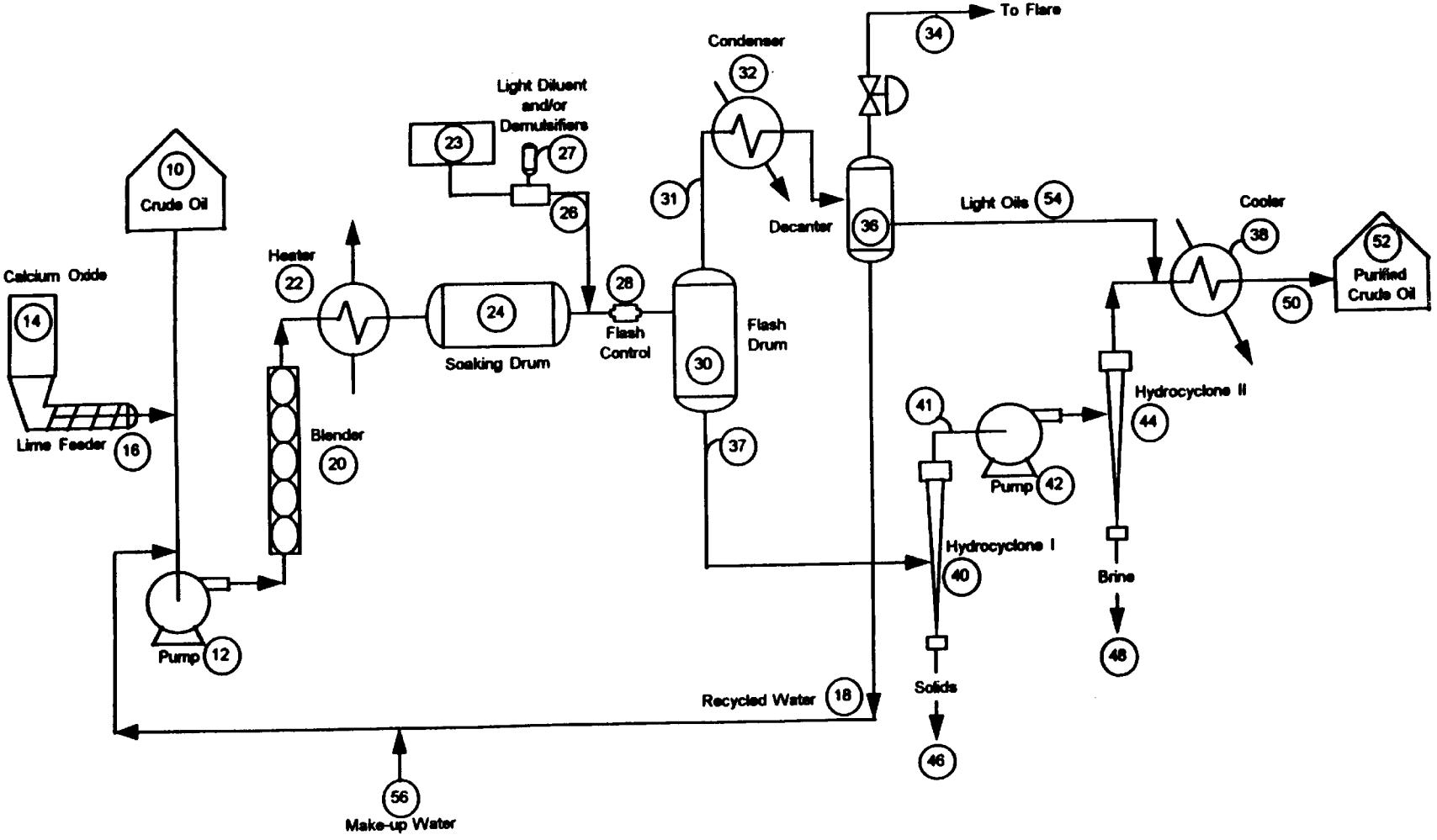
Purified Crude Oil
52
50
Cooler
38
Hydrocyclone II
44
Brine
48
Pump
42
Hydrocyclone I
40
Solids
46
41
To Flare
34
Light Oils
54
36
Decanter
Condenser
32
31
Flash Drum
30
37
Recycled Water
18
28
Flash Control
Light Diluent and/or Demulsifiers
27
26
23
24
Soaking Drum
Make-up Water
56
Heater
22
Blender
20
Crude Oil
10
Pump
12
Calcium Oxide
14
Lime Feeder
16

PROCESS TO UPGRADE CRUDE OILS BY DESTRUCTION OF NAPHTHENIC ACIDS, REMOVAL OF SULFUR AND REMOVAL OF SALTS

FIELD OF THE INVENTION

The present invention generally relates to purification of crude oil. More particularly, it relates to a method and apparatus for removing naphthenic acid and sulfur contaminants from the crude oil by reacting an alkaline earth oxide with these contaminants to convert the naphthenic acids into non-acidic compounds and the sulfur compounds into an alkaline earth sulfide.

BACKGROUND OF THE INVENTION

In the processing of crude oils, severe corrosion problems may be encountered when the crude contains noticeable amounts of organic acids, particularly naphthenic acids. Such problems are even worse when the crude oils as processed contain some salt water. Through acid exchange, salty crude oils which contain naphthenic acids may exhibit the severe corrosion characteristics of hydrochloric acid. When such oils are processed by normal distillation methods, the equipment used must be constructed of expensive corrosion resistant alloys. Conventional resolution of the naphthenic corrosion problem by neutralization with basic compounds such as sodium hydroxide, ammonia and calcium hydroxide, is not satisfactory because the neutralized acids are still corrosive and unstable, and often act as persistent emulsifying agents, giving rise to intractable emulsions, which give rise to more processing problems. Another problem for conventional refining processes is encountered when the crude oil contains appreciable amounts of sulfur and sulfur compounds which also leads to severe corrosion problems.

Accordingly, an object of the present invention is to decarboxylate the crude i.e., to convert the naphthenic acid contaminants found in the crude oil to non acidic compounds. Another object of the present invention is to provide a method for removing the sulfur found in the crude oil in the form of mercaptans, sulfides, hydrogen sulfide and cyclical compounds. Yet another object of the invention is to provide a continuous method and apparatus for removing acidic contaminants by decarboxylating the crude and also for removing the sulfur, and any solids, salts, water and other corrosive agents, to yield a clean, sweet oil eminently suitable for conventional refinery processes. Moreover, the present invention can effectively be used with any type of crude oil having oil-water emulsions stabilized by finely divided solid materials. These emulsions can be separated into an economically processable oil fraction which is low in both suspended solids, water, heavy metals, sulfur, naphthenic acids, salts and other contaminants, an ecologically acceptable waste water fraction, and, preferably, flocculated finely divided clean oil-free solids which can easily be disposed of.

SUMMARY OF THE INVENTION

The present invention obviates these problems by providing a method for decarboxylating the crude and removing the sulfur from the crude by adding to the crude oil an alkaline earth metal oxide; preferably, followed by good mixing to form a well-mixed mixture. The alkaline earth metal oxide is added at an effective amount to: a) convert substantially all naphthenic acids to the corresponding non-acidic compounds, and b) to combine with substantially all sulfur contained in the crude in the form of mercaptans, sulfides, hydrogen sulfide and cyclical compounds. The effective amount can be easily determined by one skilled in the art by performing a few, simple analyses to determine the contaminant content of the crude. Preferably, the amount added should range from about 1.2 to about 3.0 times the molecular amount necessary to react with the carboxyl groups and sulfur contained in the crude, and most preferably from about 1.5 to about 2.0 times the stoichiometric amount. The mixture is heated under a pressure to prevent vaporization to a temperature and for a time sufficient to react the alkaline earth oxide with the naphthenic acids and the sulfur. The mixture should be heated to a temperature of at least about 200° C., preferably of from about 230° C. to about 500° C., and most preferably of from about 250° C. to about 350° C. The reaction time may range from about 1 minute to about 30 minutes, preferably from about 5 minutes to about 20 minutes and most preferably from about 10 minutes to about 15 minutes. The pressure of the mixture may range from about 260 to about 600 psi gauge, preferably from about 350 to about 500 psi gauge. Under these conditions the naphthenic acids are converted into non acidic compounds accompanied by the formation of alkaline earth carbonate. Also, the sulfur contained in the crude reacts with the alkaline earth oxide to form alkaline earth sulfide. The alkaline earth carbonate and the alkaline earth sulfide and excess oxide are then separated from the crude. Calcium oxide is the preferred alkaline earth oxide with barium or magnesium oxide as viable alternatives.

A preferred embodiment of the present invention further comprises the steps of flashing the heated mixture into a lower pressure prior to the separating step to break any oil-water emulsions according to the process described in U.S. Pat. No. 4,938,876, issued to Ohsol, and which is incorporated herein by reference for all purposes. The method may further comprise the step of adding an effective amount of water to desalt the crude. Preferably, demulsifying, flocculating and complexing agents may also be introduced into the mixture before the flashing step. These agents facilitate the breaking of the emulsion which is accomplished in the flashing step. The emulsion, if present, is thereby broken into its components and the non-vaporized portion of the material which entered the flashing zone is now amenable to complete separation by conventional means such as settling, centrifugation, hydrocycloning and filtration. This way the present invention accomplishes decarboxylation of the crude, removal of sulfur and removal of salts, water, and solids including the solids formed from the reaction of the naphthenic acids and sulfur contaminants with the alkaline earth oxide.

BRIEF DESCRIPTION OF THE DRAWING

The attached FIGURE illustrates the preferred embodiment of the invention in schematic form. It particularly shows the step of adding calcium oxide into the crude oil, followed by intense mixing, heating the mixture using indirect heat or direct injection of superheated water and/or steam, followed by flashing the mixture to a lower pressure and separating the components of the mixture by centrifugally enhanced separation steps.

DETAILED DESCRIPTION OF THE INVENTION

The preferred embodiment of the present invention is shown in the FIGURE. Accordingly, crude oil contaminated with acidic contaminants such as naphthenic acids, salt and sulfur compounds in the form of mercaptans, sulfides and hydrogen sulfide, is pumped from storage tank 10 by means of a pump 12, which may be a high pressure centrifugal pump to a pressure of at least about 300 psi gauge, preferably from about 350 to about 500 and most preferably from about 400 to about 450 psi gauge. An alkaline earth oxide, preferably calcium oxide, or barium oxide and most preferably calcium oxide from hopper 14 is fed by feeder 16 into the crude oil entering suction of pump 12, preferably with recycled condensate water from line 18. The oxide is preferably fed in the form of a fine powder having a particle size from about 150 to about 300 mesh, preferably from about 200 to about 250 mesh. Feeder 16 may be a screw feeder or any other type that is suitable for moving fine powders. The oxide can also be fed as a suspension in water in which instance a feeder suitable for volumetrically moving water suspensions should be used. A suspension of calcium oxide in water, also known as milk of lime, is suitable.

The crude with the alkaline earth oxide issuing from pump 12 is then blended in blender 20, shown as an in-line blender, to form a well-mixed mixture. The mixture is then conducted through heater 22 to be heated to a temperature sufficient to react the alkaline earth oxide with the naphthenic acids and the sulfur. The mixture should be heated to a temperature of at least 200° C., preferably of from about 230° C. to about 500° C., and most preferably of from about 250° C. to about 350° C. Decarboxylation of the crude can also be accomplished at a temperature lower than about 200° C. but greater than about 150° C. but the reaction of the oxide with the sulfur compounds requires a higher temperature, at least about 200° C. Although not shown, the temperature of the mixture can also be raised by the addition of superheated water and/or steam to the pressurized oil mixture. For those emulsions that contain inorganic solids, the use of a flocculating agent may be desirable as disclosed in U.S. Pat. No. 4,938,876 and which is incorporated herein for all purposes.

The heated mixture now passes through a soaking drum 24 which is sized to provide a residence time of at least 1 minute, preferably form about 5 minutes to about 20 minutes, and most preferably from about 10 minutes to about 15 minutes to provide reaction time and conditions for the naphthenic acids to be converted into non-acidic hydrocarbons and to form an alkaline earth metal carbonate according to the following simple reaction:

$$RCOOH+MO \rightarrow R—H+MCO_3$$

wherein R is an alkyl, and M is an alkaline earth metal, preferably as described in this discussion, calcium. Also, the sulfur contained in the crude reacts with the alkaline earth metal oxide to form alkaline earth sulfide according to the following reactions (using calcium as an example):

$$R—CH_2—S—CH_2—R^1+CaO \rightarrow R—CH=CH—R^1+CaS+H_2O$$

$$R—CH_2SH+R^1—CH_2SH+2CaO \rightarrow R—CH=CH—R^1+2CaS+2H_2O$$

The alkaline earth carbonate and the alkaline earth metal sulfide can be easily removed from the crude using conventional separation techniques for the removal of solids that are well known in the art.

Returning to the process discussion, the interior of the soaking drum may also be provided with suitable baffles to keep the contents well mixed. Preferably, upon issuing from the soaking drum 24, an effective amount of demulsifying agents may be added in the mixture. These agents facilitate the breaking of the emulsion which takes place in the flashing step. It should be understood that these agents may be added at any point before the flashing step. The mixture may also be treated with a metal complex-forming compound in the presence of a surfactant in order to isolate any heavy metals present in the oil mixture as disclosed in U.S. Pat. No. 4,938,876 which is incorporated herein for all purposes. For instance, as shown in the FIGURE, these agents may be injected from a vessel 23 using a pump 27 through line 26 downstream of the soaking drum 24. Pump 27, is preferably a high-pressure proportioning pump. These agents are generally added in small amounts and are carefully controlled, based on an analysis of the entering crude—i.e., the water and solids content, the nature of the oil and of the solids. For instance, a first agent may be a surfactant or surface tension lessening agent such as a polyethylene oxide-alkyl phenol condensation product, non-ionic in charger, while another treating agent may be a flocculating agent such as a polyacrylamide or modified polyacrylamide or derivative thereof, cationic in character. The amounts used may, for example, be 0.005 weight percent to 0.05 weight percent based on the entering crude. The amounts used will depend on the particular treating agent and the nature of the crude, and may be as low as 0.0005 percent (5 parts per million) or as high as 0.10 percent (1000 parts per million). A third treating agent may be a complexing agent such as citric acid, glycolic acid or EDTA, the purpose of which is to sequester metal contaminants contained in the oil and bring them out into the water phase. The third agent will also be added in a suitably small amount in the range of from about 50 to about 500 parts per million. For a detailed discussion of the use of demulsifying, flocculating and complexing agents is provided in U.S. Pat. No. 4,938,876, issued to Ohsol, and which is incorporated herein by reference for all purposes.

The heated mixture is then flashed through control device 28 which releases the mixture to a pressure of from about 90 psi to about 1 psi gauge, preferably of from about 50 to about 5 psi and most preferably of from about 30 to about 5 psi gauge, as it enters flash drum 30. The released light hydrocarbon and water vapors from flash drum 30 pass through line 31 into condenser 32 where they are condensed into light oils and water. Stream 31 may be mostly light hydrocarbons and a small amount of water or may be mostly water with relatively less hydrocarbons, depending on the boiling range of the crude oil and the amount of water entering the flash control. Typically, the stream can be about 50% water. This flashing step besides achieving rapid cooling has the additional benefit of assisting to rupture the micro-structure of solids protecting the oil-water interfaces, which has inhibited normal oil-water separation by settling/coagulation of droplets. Once the flashing step has ruptured the micro-structure of solids protecting the oil-water interfaces, which has inhibited normal oil-water separation by settling/coagulation of droplets, the solids contained in the crude may be removed using conventional means such as cyclone or hydrocyclone separators, centrifuges, screens, and other separation devices well known in the art. It should be understood that the flashing step is not necessary in the practice of the present invention but it is preferred for separating hard to break oil-water emulsions. In some cases it may be desirable to flash to a somewhat higher pressure such as 50 psi gauge in order to keep the temperature of the flashing crude fairly high so as to have a reasonably low viscosity for heavy crude oils. Referring to the FIGURE, any non-condensable gases from decanter 36 are released through pressure control valve 34 and pass into a flare for burning and release to the atmosphere. These non-condensables typically are $C_1$ to $C_4$ hydrocarbons, $H_2S$, $CO_2$ and CO.

The condensed liquids are allowed to settle in decanter 36. An upper light oil layer is formed and is drawn off through line 54 to be released directly to a product storage tank 52. Water accumulates as the bottom layer and leaves the bottom of the decanter to be is recycled as stream 18 along with additional make-up water stream 56. The bulk, 80% to 90%, of the stream which entered flash drum 30 remains unvaporized and is released via line 37 into a first hydrocyclone 40 in which separates the solids from the liquids. Hydrocyclone 40 enhances the rate of settling of the solids by centrifugal force. Hydrocyclone 40 separates the calcium carbonate and calcium sulfide and any unconverted calcium oxide from the oil and water along with other solids which may have been contained in the original crude oil. The solids settle at the bottom, narrow end of this conical device and are removed through line 46 for disposal or further processing. (For example, the calcium carbonate can be reconverted into reusable calcium oxide by heating in a rotary kiln.)

The retained liquids 41 from hydrocyclone 40 are pressurized using conventional pump 42 and are fed into a second hydrocyclone 44 which separates the brine from the oil. Brine comes out from the narrow end 48 of the hydrocyclone 44. The purified crude oil exits as the major effluent from the other end of the hydrocyclone 42 and is fed through line 50 and cooler 58 into the product storage tank 52.

The alkaline earth metal oxide is added at an effective amount, which is an amount that is sufficient to: a) convert substantially all naphthenic acids to the corresponding non acidic compounds, and b) to combine with substantially all sulfur contained in the crude in the form of mercaptans, sulfides, hydrogen sulfide and cyclical compounds. The effective amount can be easily determined by one skilled in the art by performing a few, simple analyses to determine the amount of acidic contaminant, normally carboxyl and sulfur compounds. Preferably, the amount added should range from about 1.2 to about 3.0 times the chemical equivalent of the naphthenic acids and sulfur contained in the crude, and most preferably from about 1.5 to about 2.0 times the theoretical requirement, by weight. Preferably the alkaline earth oxide is added to the crude oil at an amount sufficient to essentially convert all naphthenic acids to hydrocarbons and all sulfur contained in the crude to the corresponding alkaline earth sulfide.

The preferred embodiment of the invention described in the FIGURE provides a continuous process capable of decarboxylating, desalting and sweetening crude oil. The process of the FIGURE is particularly useful in treating oil-water-solid emulsions that are hard to separate. However, nothing in the present disclosure of this invention should be interpreted as limiting the present invention to the above continuous process. For instance, decarboxylation can be accomplished independently of any sulfur removal or desalting of the crude. Also, desalting can occur before treating the oil with calcium oxide, by mixing with sufficient water to effectively desalt the crude oil, agitating the mixture and separating the brine from the oil.

EXAMPLES

To illustrate the present invention, the following illustrative embodiments are given. It is to be understood, however, that the embodiments are given for the purpose of illustration only and that the invention is not to be regarded as limited to any of the specific materials or conditions used in the specific embodiments.

For purposes of convenience, unless otherwise clearly set forth, percentages are given in this specification by weight, but may be volume ratios or percentages where other methods of reporting are preferred.

Example 1

100 barrels approximately 33,000 pounds of a North Sea crude oil containing 0.96% naphthenic acids and 0.03% salt, with a BS&W content of 1.5% is treated with 355 pounds of 200 mesh lime and 210 gallons (1,750 pounds) of water. The well dispersed mixture is heated to 500° F. (260° C.) under a pressure of 685 psi gauge and held at this condition in a soaking drum for 8 minutes. This dispersion is allowed to exit the soaking drum to a preliminary flash drum held at 150 psi gauge, the temperature dropping to about 365° F. (185° C.). The un-vaporized fluids (oil, water and calcium compounds in suspension) are passed into a first hydrocyclone (operating under pressure) to separate the solid calcium compounds as the heavy phase along with a fraction of the water phase as an entrained carrier liquid. The lighter fluid exiting this first hydrocyclone is crude oil and salty water. This fluid is still under some pressure, approximately 90 psi gauge, sufficient to force it through a second hydrocyclone which discharges salty water as the heavy phase and clean crude oil as the lighter phase. The crude oil is essentially free of naphthenic acids (less than 0.03%). The salt content is also very low, down to 0.0015%. The light hydrocarbons vaporized in the first flashing step are condensed and added to the recovered crude oil. The water vapor from the first flashing step is condensed and found to be suitable for recycle.

Example 2

100 barrels of the same North Sea crude oil as used in Example 1 are blended with 350 pounds of finely divided (200 mesh) calcium oxide and 1,700 pounds of water (204 gallons) using a high speed blender providing a 1.0% dispersion of the solids in the liquid. The dispersion is then heated under a pressure of approximately 100 psi gauge to about 300° F. by pumping it through a steam-heated heat exchanger. After heating, 750 parts per million by weight of an emulsion breaking chemical surfactant, Breakxit No. 125, was injected and well mixed into the flowing stream of oil. The thus treated oil stream is released in pressure from slightly under 100 psi gauge to approximately 20 psi gauge through a streamlined pressure let-down nozzle causing a portion of the contents to flash into vapor (water vapor and light end hydrocarbons), while causing the temperature to drop to about 260° F. (127° C.). Considerably more hydrocarbon and water vapor is released than in Example 1. The remaining liquid contains the bulk of the crude oil with an appreciable amount of water, lime and salt. This mixture is then passed through a "hydrocyclone," a long conical device for separating phases of different specific gravity by causing a rapid rotation of the entering fluid. The oil and the bulk of the water passes out from the low gravity discharge (larger diameter) end of the hydrocyclone, while the hydrated lime suspension plus any solids contained in the original crude oil (about 0.2 weight percent) passes out through the high gravity discharge port (the small diameter end of the cone). The oil and water mixture from the large diameter end of the hydrocyclone issuing at a pressure of about 5 psi gauge is then pumped at a steady flow rate to enter a second hydrocyclone at a pressure of about 50 psi gauge. The large diameter end of the second hydrocyclone discharges desalted crude oil with less than one-tenth of one percent (0.1%) entrained water, while the small diameter end discharges essentially all the water, containing the salt originally in the crude oil, and a small amount of entrained oil. This oily salt water is subjected to purification and discharge.

The desalted crude oil is then re-mixed with the solids concentrate containing essentially all the lime in a blending tank, well agitated and pumped into a high pressure, high temperature soaking tank, with a residence time of twelve minutes at 500° F. (260° C.). The temperature is attained through the use of an electrically heated jacket, and the pressure is maintained at about 400 psi gauge. Agitation is achieved through the use of reversing helically oriented baffles inside the soaking tank (a "Kenics" mixing system).

The dispersion issues from the soaking tank through a streamlined pressure let-down valve into a cooling and settling tank, allowing the suspension to cool to below 250° F. (120° C.) at 50 psi gauge. The bottoms from this settling tank are released through a centrifuge to separate calcium carbonate and calcium oxide from the hot oil. A sample of the recovered crude oil shows only 0.01% naphthenic acids. The solids recovered from the centrifuge were measured at 245 pounds of calcium carbonate and 210 pounds of residual lime.

The recovered oil is suitable for normal refinery processing. As in Example 1, the vapors condensed from the flash step are usable—the hydrocarbons can be added to the clean crude oil, and the water is of a quality to be recycled.

Example 3

In this example a high-sulfur crude oil is treated in a 100 barrel test facility. 100 barrels of a crude oil containing 0.05% naphthenic acids, 3.5% (by weight) of sulfur and 2.0% B.S.&W. Its specific gravity is 0.946 (18° API). Its salt content is 0.05%.

This oil is blended with 2200 pounds of calcium oxide and 50 gallons of water, and well agitated. The dispersion is then heated under pressure to 500° F. as in Example 2, allowed to soak at this temperature for 20 minutes and then released to 150 psi gauge and 365° F. Released vapors are condensed, and the retained slurry is hydrocycloned in a larger first stage hydrocyclone to remove approximately 2500 pounds of calcium sulfide and 200 pounds of calcium oxide-calcium carbonate mixture, along with 250 pounds of water and oil, adhering liquid. These solids are subsequently washed and dried in a high speed centrifuge. The liquid effluent from the first stage hydrocyclone is passed into a second stage hydrocyclone to remove the remaining salty water, approximately 200 pounds. The recovered oil from the second hydrocyclone constituted 95% of the inlet crude oil, and had a sulfur content of 0.25%, a salt content of less than 0.001% and a BS&W reading of less than 0.2%. The condensed overheads from the flash step are recycled as in the previous example.

From the foregoing description and prophetic examples of specific embodiments of the present invention, those of ordinary skill in the art would readily recognize many variations of the practice of the invention set forth in the disclosure above and covered by the appended claims without departing from the intended scope of the appended claims.

What is claimed is:

1. A method for upgrading an oil stream containing acidic contaminants which comprises:

adding an alkaline earth oxide to the oil stream at an effective amount to convert substantially all naphthenic acid contaminants to corresponding non-acidic compounds to form a mixture;

heating the mixture under a pressure sufficient to prevent vaporization of the mixture to a temperature and for a time sufficient for the naphthenic acid contaminants to react with the alkaline earth oxide to form a mixture of petroleum for processing and an alkaline earth carbonate;

separating the alkaline earth carbonate to recover the petroleum.

2. The method of claim 1 wherein the alkaline earth oxide is selected from the group consisting of calcium oxide and barium oxide.

3. The method of claim 2 wherein the alkaline earth oxide is calcium oxide.

4. The method of claim 3 wherein the heating step involves heating the mixture to a temperature of at least about 150° C. and for a time of at least about 5 minutes.

5. The method of claim 4, further comprising the step of flashing said heated mixture into a lower pressure as the initial separation step.

6. The method of claim 5, further comprising the steps of adding water at an effective amount to desalt the oil prior to the flashing step, and separating the water containing the salt after the flashing step.

7. The method of claim 6, further comprising the step of adding a demulsifying agent to said mixture.

8. The method of claim 7 further comprising the step of adding a flocculating agent to said mixture.

9. The method of claim 8, further comprising the steps of adding a demulsifying agent and adding a flocculating agent prior to the flashing step.

10. The method of claim 9 wherein said flocculating and said demulsifying agent are added to the mixture substantially simultaneously.

11. The method of claim 10 wherein said flocculating and demulsifying agents are added to the mixture in the amount of 10 ppm to 1000 ppm by weight.

12. The method of claim 11 further comprising the step of adding a complexing agent.

13. The method of claim 12 where said complexing agent is added in the amount of 50–500 ppm by weight.

14. The method of claim 1 further comprising the step of agitating said mixture.

15. The method of claim 5 wherein said heated mixture is flashed into a pressure of about 1 atmosphere gauge.

16. A method for upgrading an oil stream containing naphthenic acid and sulfur contaminants which comprises:

adding an alkaline earth metal oxide to the oil stream to form a mixture wherein said alkaline earth oxide is added at an effective amount to convert substantially all naphthenic acid contaminants to corresponding non-acidic compounds and substantially all sulfur contaminants to alkaline earth sulfide;

heating the mixture under a pressure sufficient to prevent vaporization of the mixture to a temperature sufficient and for a time sufficient to react the naphthenic acid contaminants with the alkaline earth oxide to form the corresponding non-acidic compounds and alkaline earth carbonate and the sulfur contaminants with the alkaline earth oxide to form the alkaline earth sulfide;

flashing the heated mixture into a lower pressure prior to separation; and separating the alkaline earth carbonate and alkaline earth sulfide.

17. The method of claim 16 wherein the alkaline earth oxide is selected from the group consisting of calcium oxide and barium oxide.

18. The method of claim 17 wherein the alkaline earth oxide is calcium oxide.

19. The method of claim 18 wherein the heating step involves heating the mixture to a temperature of at least 250° C. and for a time of at least 5 minutes.

20. The method of claim 16, further comprising the steps of adding an effective amount of water to desalt the oil stream prior to the flashing step, and separating the water containing the salt after the flashing step.

21. The method of claim 20, further comprising the step of adding a demulsifying agent to said mixture.

22. The method of claim 21 further comprising the step of adding a flocculating agent to said mixture.

23. The method of claim 22, further comprising the steps of adding a demulsifying and adding a flocculating agent prior to said flashing step.

24. The method of claim 23 wherein said flocculating and said demulsifying agent are added to the mixture substantially simultaneously.

25. The method of claim 24 wherein said flocculating and demulsifying agents are added to the mixture in the amount of 10 ppm to 1000 ppm by weight.

26. The method of claim 25 further comprising the step of adding a complexing agent.

27. The method of claim 26 where said complexing agent is added in the amount of 50–500 ppm by weight.

28. The method of claim 16 further comprising the step of agitating said mixture.

29. The method of claim 16 wherein said heated mixture is flashed into a pressure of about 1 atmosphere gauge.

30. The method of claim 16 further comprising the step of adding sodium hydroxide to aid and abet the function of the alkaline earth oxide.

31. The method of claim 16 wherein said alkaline earth oxide is added at a molar equivalent of from about 1.5 to about 2.0 times the total mols of the naphthenic acids and sulfur contaminants contained in the oil.

32. A method for upgrading an oil stream containing naphthenic acid and sulfur contaminants which comprises:

adding calcium oxide to the oil stream wherein said calcium oxide is added at an amount of from about 1.5 to about 2.0 times the total theoretical requirement for converting all carboxyl groups to $CaCO_3$ and all sulfur to CaS;

mixing the calcium oxide with the oil stream to form a well-mixed mixture;

heating the mixture under a pressure sufficient to prevent vaporization of the mixture to a temperature of from about 250° C. to about 500° C. for a time of from about 5 minutes to about 15 minutes to react the naphthenic acid with the calcium oxide to form the corresponding non-acidic compounds and calcium carbonate and the sulfur contaminants with the calcium oxide to form calcium sulfide;

separating the alkaline earth carbonate and calcium sulfide.

* * * * *